US006467410B1

(12) United States Patent
Rasmussen et al.

(10) Patent No.: US 6,467,410 B1
(45) Date of Patent: Oct. 22, 2002

(54) METHOD AND APPARATUS FOR USING A VACUUM TO REDUCE COCKLE IN PRINTERS

(75) Inventors: Steve O Rasmussen, Vancouver, WA (US); John D. Rhodes, Vancouver, WA (US); Geoff Wotton, Battleground, WA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/484,566

(22) Filed: Jan. 18, 2000

(51) Int. Cl.[7] ..... B41F 35/00

(52) U.S. Cl. ..... 101/424.1; 347/102; 347/104; 358/1.12; 271/197

(58) Field of Search ..... 101/424.1, 416.1, 101/287; 358/1.12; 347/102, 104; 400/645; 271/96, 197

(56) References Cited

U.S. PATENT DOCUMENTS

| | | | | | |
|---|---|---|---|---|---|
| 3,741,116 | A | * | 6/1973 | Green et al. | 101/287 |
| 4,205,779 | A | * | 6/1980 | Gamblin et al. | 347/104 |
| 4,208,666 | A | * | 6/1980 | Paranjpe | 347/104 |
| 4,237,466 | A | * | 12/1980 | Scranton | 347/104 |
| 4,285,507 | A | | 8/1981 | Marinoff | |
| 4,447,817 | A | * | 5/1984 | Naramore | 347/104 |
| 5,105,210 | A | * | 4/1992 | Hirano et al. | 347/104 |
| 5,510,822 | A | * | 4/1996 | Vincent et al. | 347/102 |
| 5,548,388 | A | * | 8/1996 | Schieck | 271/197 |
| 5,650,808 | A | * | 7/1997 | Vincent et al. | 347/43 |
| 5,757,407 | A | * | 5/1998 | Rezanka | 347/102 |
| 5,896,154 | A | * | 4/1999 | Mitani et al. | 347/102 |
| 5,992,994 | A | * | 11/1999 | Rasmussen et al. | 347/104 |
| 6,022,104 | A | * | 2/2000 | Lin et al. | 347/102 |
| 6,210,055 | B1 | * | 3/2000 | Chen et al. | 347/104 |
| 6,079,888 | A | * | 6/2000 | Chen et al. | 347/104 |
| 6,106,623 | A | * | 8/2000 | Nishikawa | 101/416.1 |
| 6,139,140 | A | | 10/2000 | Rasmussen et al. | 347/104 |
| 6,147,777 | A | * | 11/2000 | Jung | 347/102 |
| 6,154,232 | A | | 11/2000 | Hickman et al. | 347/40 |
| 6,168,269 | B1 | * | 1/2001 | Rasmussen et al. | 347/102 |
| 6,172,741 | B1 | | 1/2001 | Wotton et al. | 355/73 |
| 6,179,419 | B1 | | 1/2001 | Rasmussen et al. | 347/104 |
| 6,209,867 | B1 | | 4/2001 | Madsen et al. | 271/276 |
| 6,224,203 | B1 | | 5/2001 | Wotton et al. | 347/101 |
| 6,254,081 | B1 | * | 7/2001 | Rasmussen et al. | 271/96 |
| 6,328,440 | B1 | * | 12/2001 | Medin et al. | 347/102 |
| 6,336,722 | B1 | * | 1/2002 | Wotton et al. | 347/102 |
| 6,367,999 | B1 | * | 4/2002 | Juan et al. | 400/645 |

FOREIGN PATENT DOCUMENTS

| | | | | |
|---|---|---|---|---|
| GB | 2351703 | | 1/2001 | |
| JP | 406055731 A | * | 3/1994 | 347/102 |

OTHER PUBLICATIONS

European Search Report, Apr. 12, 2001.

* cited by examiner

*Primary Examiner*—Eugene H. Eickholt

(57) ABSTRACT

In a printer, liquid ink is applied to a print medium as the medium is passed through the printer. A low pressure zone is generated along one surface of the print medium to hold a portion of the print medium substantially flat for a period of time during and after the liquid ink is applied to the print medium. By subjecting the portion of the print medium to the low pressure zone, cockling of the print medium is prevented.

17 Claims, 5 Drawing Sheets

METHOD AND APPARATUS FOR USING A VACUUM TO REDUCE COCKLE IN PRINTERS

TECHNICAL FIELD

This invention relates to printers. More particularly, the invention relates to using a vacuum to reduce print medium cockle in printers.

BACKGROUND

Computer technology is continually advancing, expanding the need for computers in the personal, business, and academic fields. As the need for computers has grown, so too has the need for various peripheral devices for use with computers, such as printers. A wide variety of printers exist that operate in a wide range of manners, however all share the same fundamental purpose of generating a "hard copy" of data, whether it be on paper, on transparencies, etc.

One type of printer, commonly referred to as an "inkjet" printer, operates by applying liquid ink directly onto a sheet of paper. An inkjet printer typically includes one or more cartridges, commonly referred to as "pens", each having a print head formed with very small nozzles through which the ink drops are "shot" or "fired" onto the paper. The particular ink ejection mechanism within the print head may take on a variety of different forms known to those skilled in the art, such as those using piezo-electric or thermal print head technology. To print an image, the print head is scanned back and forth across a print zone above the sheet, with the pen shooting drops of ink as it moves.

Regardless of the type of print head technology used, when the ink is applied to the paper, the paper absorbs the moisture in the ink. During printing, the amount of moisture absorbed by a portion of the paper is dependent on a variety of factors, including the amount of ink applied to the portion (the more ink that is applied, the more moisture there is to absorb), as well as the composition of the ink (the more liquid there is in the ink, the more moisture there is to absorb).

When one or more portions of the paper absorb more moisture than other portions of the same sheet of paper, the different portions of the paper expand at different rates and in different amounts. This causes the paper to become wavy, wrinkled, or corrugated, an effect commonly referred to as "cockle." Cockle is a problem on paper that has high concentrations of ink in some portions and no ink in other portions, such as a presentation slide that has a white border (which has no ink and does not expand) and an ink-saturated inner portion (which attempts to expand substantially). The outer border restricts the expansion of the inner portion and results in a significant degree of cockle. Cockle also becomes a greater problem as the thickness of the paper decreases (thicker paper is stiffer and better able to resist cockle growth). The rate at which ink is applied to the paper can also affect cockle growth—the slower the application of the ink the longer the time that one area of the paper is wet due to the ink having been applied while adjacent unprinted areas are dry.

The invention described below addresses these and other disadvantages of the prior art, using a vacuum to reduce cockle in printers.

SUMMARY

In a printer, liquid ink is applied to a print medium as the medium is passed through the printer. A low pressure zone is generated along one surface of the print medium to hold a portion of the print medium substantially flat for a period of time during and after the liquid ink is applied to the print medium. By subjecting the portion of the print medium to the low pressure zone, cockling of the print medium is reduced.

According to one aspect of the invention, a porous belt and vacuum enclosure are used to generate the low pressure zone to keep the print medium substantially flat. When the print medium is fed into the print path of the printer, the medium is situated on the porous belt. The vacuum enclosure maintains the low pressure zone, pulling air through the porous belt to keep the paper substantially flat on the belt. Portions of the print medium remain on the porous belt and are subjected to the low pressure zone as the print medium is fed through the path for a period of time after ink is applied to the respective portion.

BRIEF DESCRIPTION OF THE DRAWINGS

The present invention is illustrated by way of example and not limitation in the figures of the accompanying drawings. The same numbers are used throughout the figures to reference like components and/or features.

DETAILED DESCRIPTION

Figure 1:
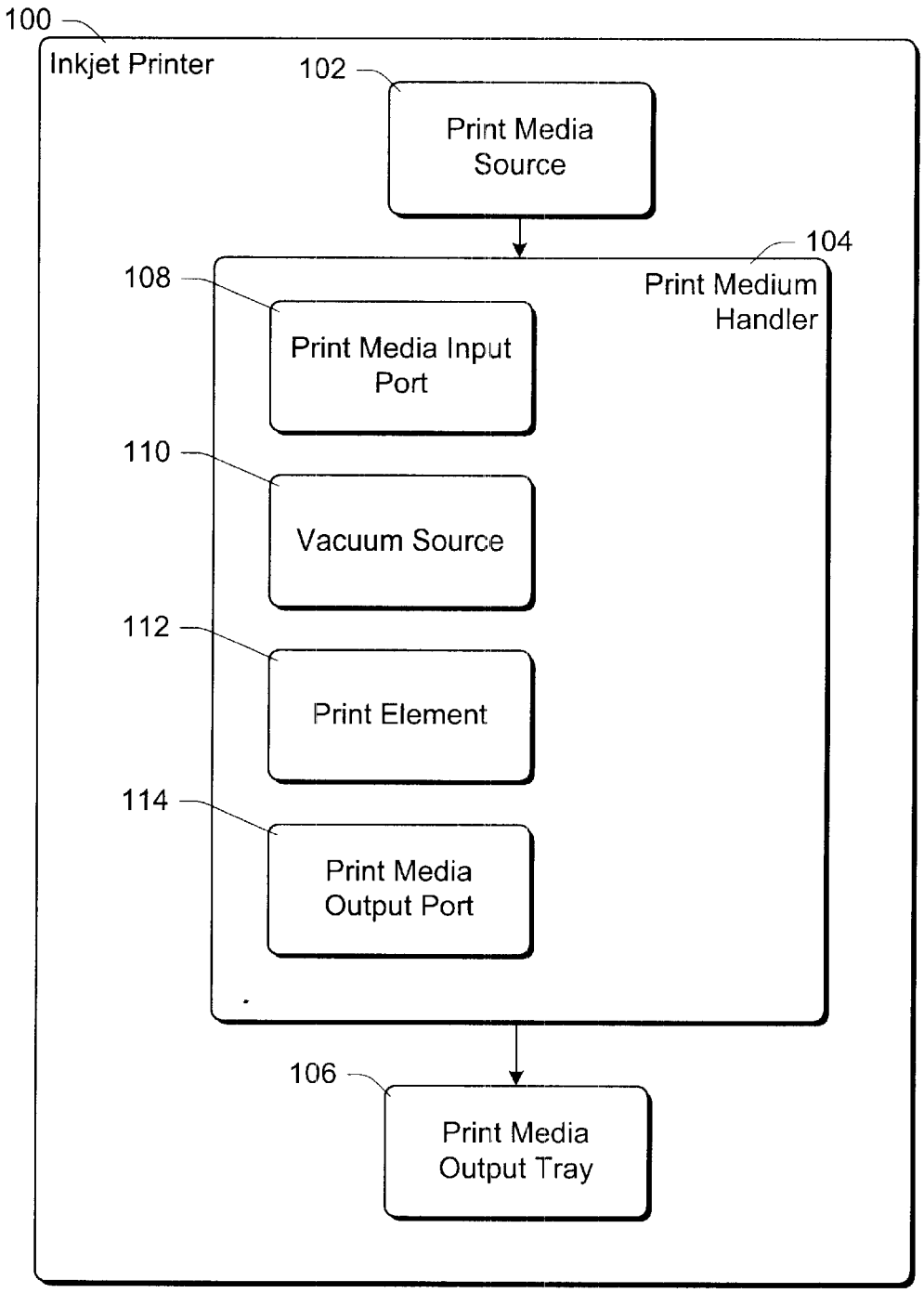
FIG. 1 is a block diagram illustrating an exemplary printer in accordance with an embodiment of the invention.

FIG. 1 is a block diagram illustrating an exemplary printer in accordance with an embodiment of the invention. For purposes of discussion, printer 100 is discussed in the context of an inkjet printer. Alternatively, printer 100 can be any of a wide variety of devices designed to produce text, images, or the like on paper or other print media. Examples of such devices include facsimile machines, photocopiers, hand-held "point of sale" devices, etc.

Inkjet printer 100 has a print media source 102 to store the print media, such as paper, cloth, transparencies, etc. Of the different types of print media that can be used with printer 100, only some may be susceptible to the problem of cockle growth. For example, paper is susceptible to cockle growth, but plastic transparencies are not. Printer 100 also includes a print medium handler 104 to pass the print media along a print media path through the inkjet printer 100, and a print media output tray 106 to collect the processed print media.

Print medium handler 104 includes a print media input port 108, a vacuum source 110, a print element 112, and a print media output port 114. Print element 112, also referred to as a "print head", applies the liquid ink to the print medium as it passes through handler 104. The liquid ink can be stored in a reservoir that is part of the same pen as the print head, or alternatively can be stored external to the pen and supplied to the pen as needed (e.g., via a flexible tubing from a main reservoir). Print medium handler 104 also includes mechanisms to physically move the print media from one component or station to the next. Examples of such mechanisms include rollers, drives, belts, path guides, motors, tractor assembly, and the like for moving the media from input port 108 to output port 114.

Vacuum source 110 generates a low pressure area or "suctioning" force to hold the print medium substantially flat as it passes through handler 104. The print medium is held substantially flat in both the scanning direction (the direction of movement of the print head as it applies the liquid ink to the print medium), as well as in the print path direction (the direction of movement of the print medium as it traverses the print path, which is substantially perpendicular to the scanning direction). Alternatively, print element may be a fixed (e.g., page-width) printhead so that movement of the print head is not necessary. However, for ease of explanation, the direction substantially perpendicular to the print path direction is still referred to as the scanning direction even though the print element may be stationary.

The force or pressure generated by vacuum source 110 holds the print medium substantially flat in both the scanning direction and the print path direction as print element 112 applies the liquid ink to the print medium and continues to hold the print medium substantially flat in both the scanning direction and the print path direction for a period of time after print element 112 applies the liquid ink to the print medium.

Continuing to hold the print medium substantially flat in the print path direction has several advantages that reduce cockle growth. As soon as the liquid ink is applied to the print medium and exposed to the air, the liquid ink begins to dry. By keeping the print medium held down after the liquid ink is applied to it, the print medium is held down as the liquid ink dries. Once the liquid ink has dried, there is no longer the moisture disparity in different portions of the print medium, thereby reducing cockle growth.

An additional advantage is that the continued application of the vacuum to the print medium helps draw the water (or similar content) of the ink into the paper or similar print medium. As the ink is slowly absorbed, cockle growth occurs due to different "depths" of the paper having different moisture contents. By continuing to apply the vacuum to the print medium, the moisture becomes distributed more evenly through the depth of the print medium, thereby reducing cockle growth.

Furthermore, the continued application of the vacuum to the print medium helps draw the water (or similar content) out of the print medium. That is, the moisture of the liquid ink is applied to one surface of the print medium, and the vacuum assists in drawing the moisture through the print medium and out the opposing surface of the print medium. Once the liquid ink has dried, there is no longer the moisture disparity in different portions of the print medium, thereby reducing cockle growth.

Figure 2:
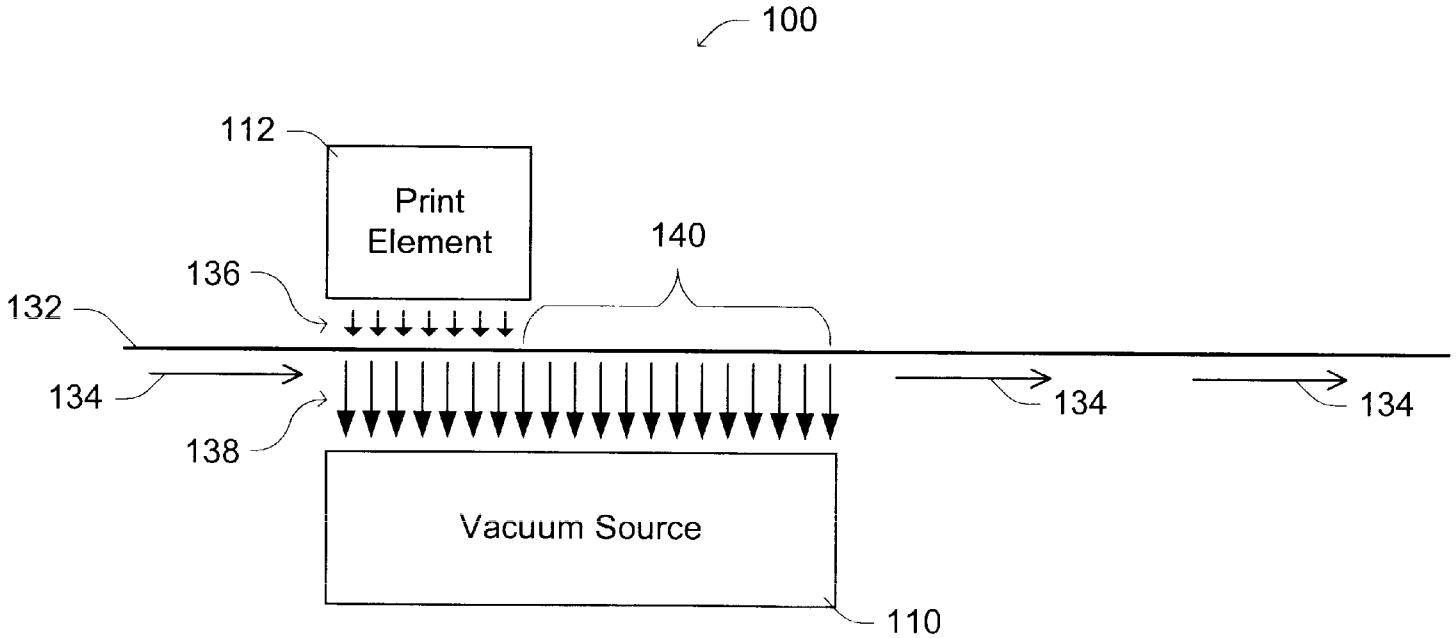
FIG. 2 is a diagram illustrating exemplary movement of paper through a printer and use of a vacuum in accordance with the invention.

FIG. 2 is a diagram illustrating exemplary movement of paper through printer 100 and use of the vacuum in accordance with the invention. A sheet of paper 132 or other print medium is fed through the printer 100 in a direction indicated by paper feed arrows 134, also referred to as the print path direction. Print element 112 applies liquid ink 136 to paper 132 as paper 132 is fed through printer 100.

Additionally, vacuum source 110 generates a low pressure area along one surface of a portion of sheet 132, creating a force that holds paper 132 substantially flat and reduces cockle growth. The direction of the force generated by vacuum source 110 is illustrated by arrows 138. As shown, the paper 132 is pulled in a direction away from print element 112. The force generated by vacuum source 110 is applied to the entire area in the scanning direction that can be printed to by print element 112. In the print path direction, the areas of paper 132 being pulled by this force include the area on which ink 136 is being applied, referred to as the "print zone", as well as a portion 140 of paper 132 that has already passed print element 112, referred to as the "stabilization zone".

The dimensions of stabilization zone 140 can vary, depending on numerous factors. These factors can include one or more of: the speed at which paper 132 is fed through printer 100, the speed at which print element 112 applies ink to paper 132, the thickness of paper 132, the water (or similar liquid) content of the liquid ink applied by print element 112, other mechanisms (not shown) used to assist in drying the paper and the ink, etc. In one implementation, stabilization zone 140 continues for the entire width of the paper 132 in the scanning direction and for between four inches and twelve inches in the print path direction. In another implementation, the dimensions of stabilization zone 140 are defmed so that the liquid ink applied by print element 112 to a particular portion of the paper should be dry prior to that portion leaving the stabilization zone. Typically, the stabilization zone 140 will be substantially larger in the print path direction than the print zone (e.g., five to ten times larger than the print zone).

Various different gas flow systems or vacuum systems can be used to generate the low pressure. Although discussed herein as creating a low pressure or "suctioning" force of air, the invention can be used with any of a wide variety of gases.

Figure 3:
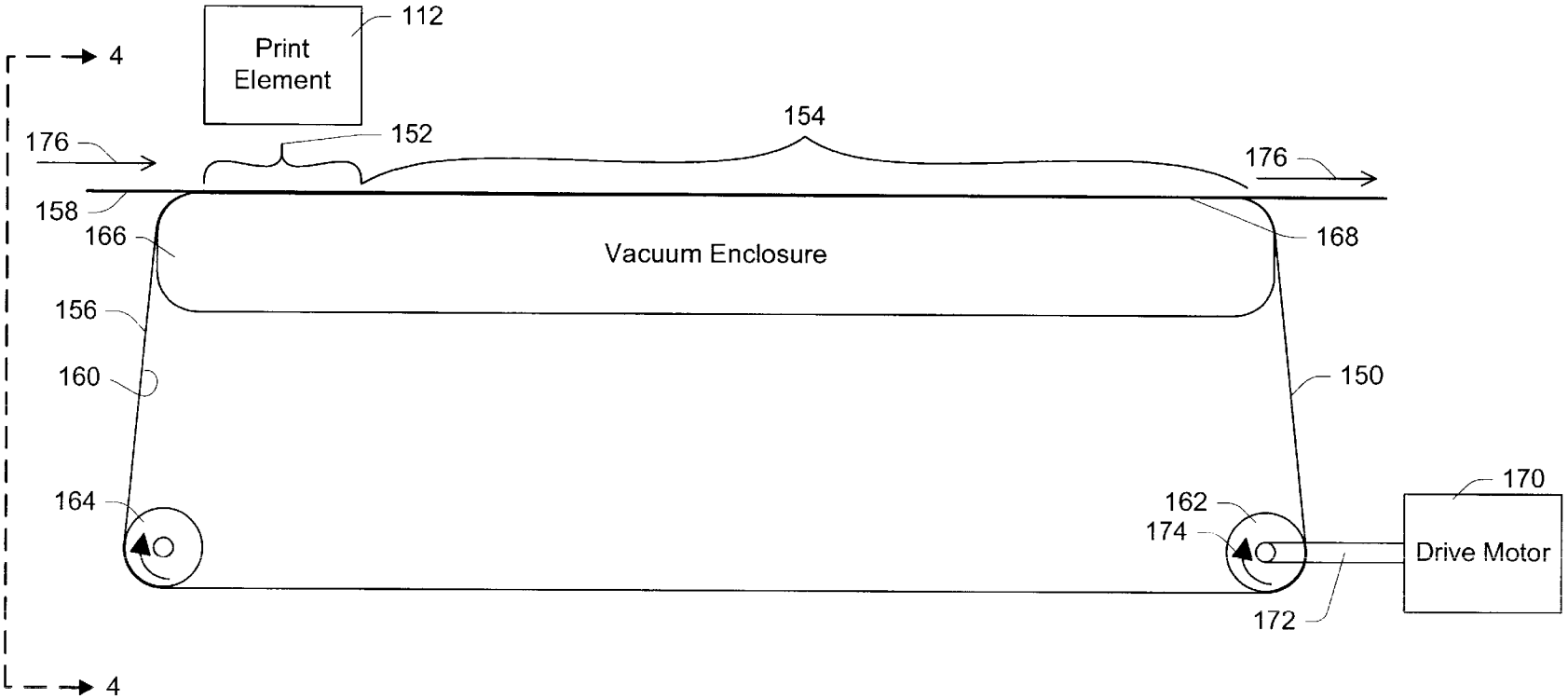
FIGS. 3 and 4 illustrate an exemplary vacuum system that can be used in accordance with the invention.
Figure 4:
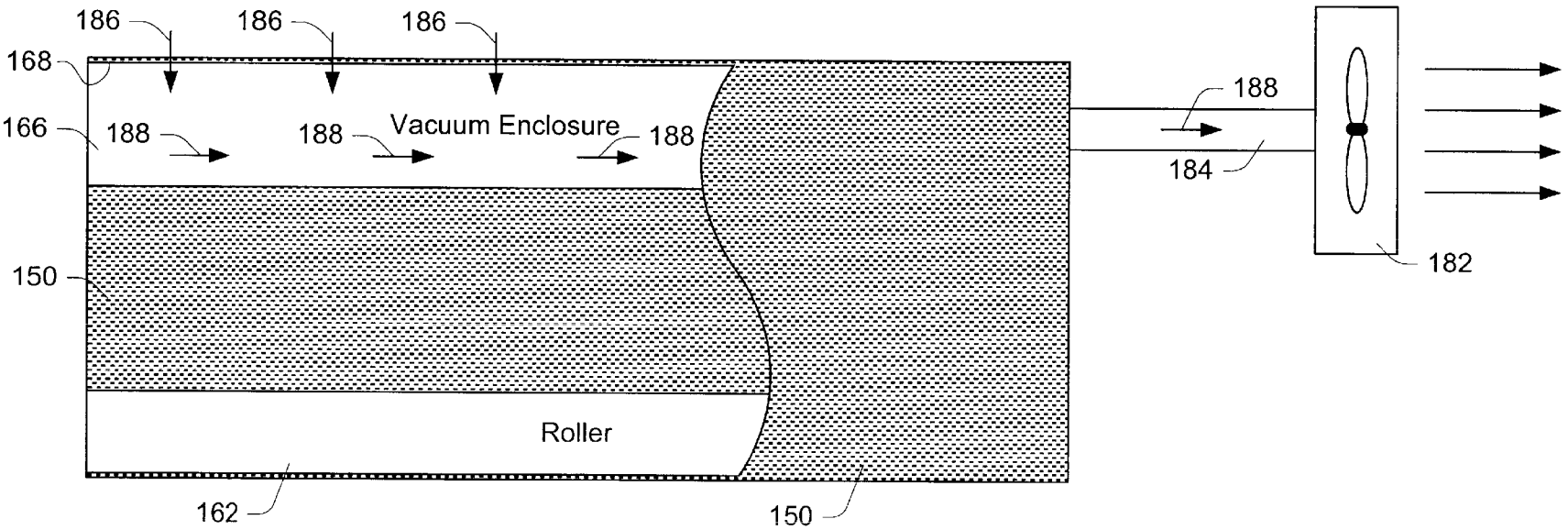

FIGS. 3 and 4 illustrate an exemplary vacuum system that can be used in accordance with the invention. An endless porous belt 150 extends along the length of a print zone 152 and a stabilization zone 154. Belt 150 has an exterior surface 156 that print medium 158 is situated on and supports print medium 158 in print zone 152 and stabilization zone 154. Belt 150 also has an interior surface 160 driven by roller 162. Roller 164 provides additional support for belt 150. The term "porous" refers to a series of openings extending through belt 150 between the interior and exterior surfaces 160 and 156. These openings through belt 150 may have various shapes and arrangements, such as slots or holes extending therethrough.

Belt 150 is supported by a vacuum enclosure 166 that extends along the length of print zone 152 and stabilization zone 154. Air can flow through openings, such as holes or slots, in upper portion 168 of vacuum enclosure 166. A drive motor 170 may be directly coupled by shaft 172, or another coupling mechanism (e.g., a gear assembly) to drive roller 162 in the direction indicated by curved arrow 174 to advance the media from print zone 152 to stabilization zone 154. The direction of media advance is indicated by arrows 176.

The use of a porous belt 150 and openings in upper portion 168 of vacuum enclosure 166 allows creation of a low pressure area in vacuum enclosure 166 to pull print medium 158 toward belt 150.

FIG. 4 is an end view of the vacuum system of FIG. 3. An arrow labeled 4 in FIG. 3 illustrates the viewpoint of FIG. 4 with reference to FIG. 3. A fan unit 182 is used to create the vacuum force. A conduit 184 couples fan 182 to vacuum enclosure 166, directly under print zone 152 and stabilization zone 154. As fan 182 operates, air is drawn through the openings of belt 150 and upper portion 168 of enclosure 166, as indicated by arrows 186, then through enclosure 166 and conduit 184, as indicated by arrows 188, and finally the air is vented to atmosphere after passing through fan 182.

Alternatively, multiple belts may be used rather than a single belt 150. Each of the multiple belts may be porous, or alternatively spacings between adjacent belts may serve the same purpose as the porous nature of belt 150 to pull the print medium toward the belt exterior surface.

Additionally, various other implementations may be used to transport the print medium through medium handler 104 of FIG. 1 so that vacuum source 110 can hold the print medium substantially flat. Multiple additional rollers may be used, mechanisms other than rollers may be used to move the belt 150 of FIG. 3, a series of porous rollers may be used rather than a belt system, etc.

Figure 5:
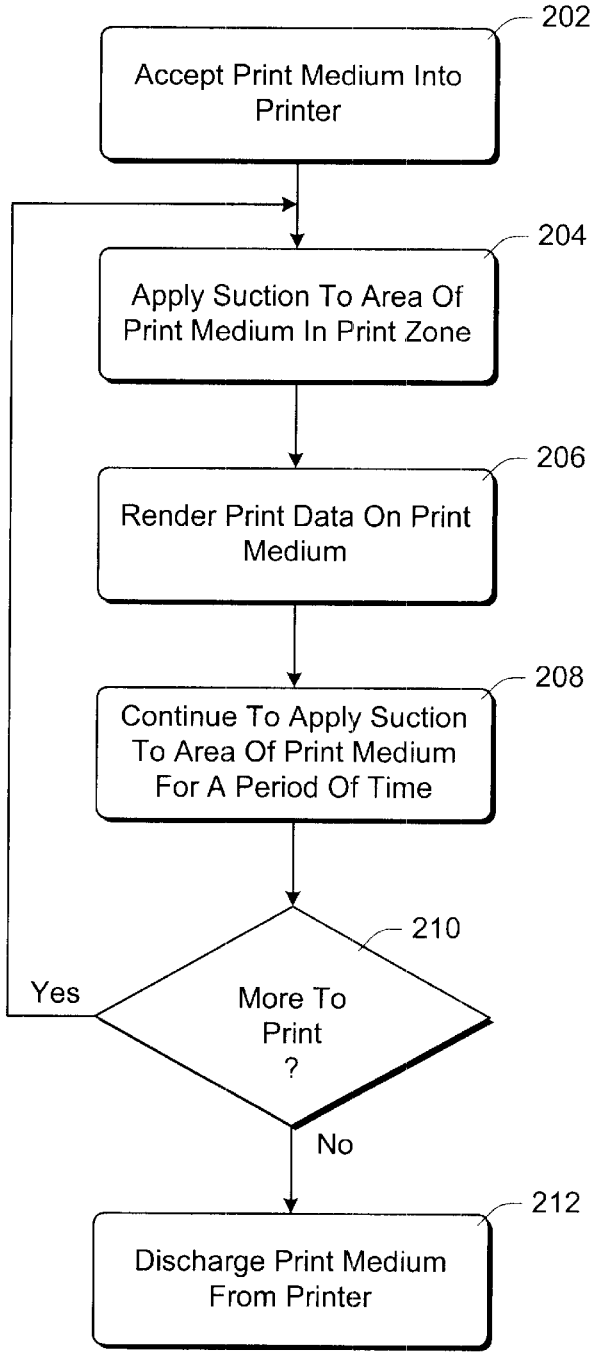
FIG. 5 is a flowchart illustrating an exemplary process for printing in accordance with the invention.

FIG. 5 is a flowchart illustrating an exemplary process for printing in accordance with the invention. Initially, the print medium is accepted into the printer (step 202). A suctioning force is then applied to an area of the print medium that is in the print zone (step 204). While the suctioning force is applied, the data to be printed is rendered on the print medium (step 206). The application of the suctioning force to the print medium continues for a period of time after printing (step 208) to reduce cockle growth. Note that the application of the suctioning force to the print medium itself is sufficient to reduce cockle growth—no other mechanism to assist in reducing or preventing cockle growth is necessary.

The application of the suctioning force and rendering of the data on the print medium (steps 204–208) is continued for each area of the print medium to be printed (step 210). Once all data has been printed and the time period for applying the suctioning force to the last area of the print medium has passed, the print medium is discharged from the printer (step 212).

Although the invention has been described in language specific to structural features and/or methodological steps, it is to be understood that the invention defmed in the appended claims is not necessarily limited to the the specific features and steps are disclosed as preferred forms of implementing the claimed invention.

What is claimed is:

1. An apparatus comprising:

a print medium handler that creates a print path via which a sheet of paper is fed through the apparatus in a first direction; and a gas flow system to reduce cockle growth in a portion of the sheet of paper by holding the portion of the sheet substantially flat, while the sheet is fed in the first direction, for a substantial period of time after the portion has been printed on using ink, wherein the portion spans the sheet in a second direction that is substantially perpendicular to the first direction and wherein the substantial period of time is sufficient for the sheet to have been fed in the first direction while multiple additional portions spanning the sheet in the second direction have been printed on, wherein the portion of the sheet is less than the entire sheet, wherein the substantial period of time is dependent on an amount of time necessary to reduce cockle growth in the sheet, and wherein the gas flow system is to hold the portion substantially flat in a zone after the portion has been printed on that is five to ten times larger than another zone that the portion is in while being printed on.

2. An apparatus as recited in claim 1, wherein printing to the portion comprises applying a liquid ink to the portion.

3. An apparatus as recited in claim 1, wherein the apparatus comprises an inkjet printer.

4. An apparatus as recited in claim 1, wherein the gas flow system includes a porous belt, wherein the print medium handler situates the sheet of paper on a first side of the belt, and wherein the gas flow system generates a low pressure zone along a second side of the porous belt in an area corresponding to the portion of the sheet of paper.

5. An apparatus as recited in claim 1, wherein the apparatus further comprises a print head that applies a liquid ink to the sheet of paper as the print head moves in the second direction.

6. An apparatus comprising:

a print medium handler to receive a print medium sheet and move the print medium sheet along a print medium path, the print medium path including a printing zone immediately followed by a stabilization zone substantially larger than the printing zone and smaller than the print medium sheet, wherein the size of the stabilization zone is further dependent on an amount of time necessary to reduce cockle growth in the print medium sheet, and wherein the stabilization zone is five to ten times larger than the printing zone; and a vacuum system to generate a low pressure zone along one surface of the print medium sheet in the stabilization zone.

7. An apparatus as recited in claim 6, wherein the stabilization zone comprises a region extending at least four inches in a direction along the print medium path.

8. An apparatus as recited in claim 6, wherein the vacuum system is further to generate the low pressure zone along the one surface of the print medium in the printing zone.

9. An apparatus as recited in claim 6, wherein the vacuum system generates the low pressure zone along a surface of the print medium opposite a surface that a liquid ink is applied to.

10. An apparatus as recited in claim 6, wherein the print medium handler includes a porous belt onto which the print medium is placed.

11. An apparatus as recited in claim 6, wherein the print medium handler moves the print medium along the print medium path in a direction that is substantially perpendicular to a scanning direction of a print head applying a liquid ink to the print medium.

12. An apparatus as recited in claim 6, wherein the stabilization zone comprises a linear distance of at least two inches.

13. An apparatus as recited in claim 6, wherein the apparatus comprises an inkjet printer.

14. An apparatus as recited in claim 6, wherein the apparatus comprises a facsimile machine.

15. A method comprising:

feeding a print medium sheet through a print path of a printer; generating a low pressure zone to pull the print medium sheet in a direction away from a print head applying a liquid ink to the print medium sheet; and reducing cockle growth in the print medium sheet by continuing to pull a portion of the print medium sheet in the direction away from the print head for a period of time while the print medium sheet traverses the print path, wherein the portion of the print medium sheet is less than the entire print medium sheet, the period of time extending substantially beyond the time required to print to the portion of the print medium sheet, wherein the period of time is further dependent on an amount of time necessary to reduce cockle growth in the print medium sheet, and wherein the low pressure zone pulls the portion while in a zone after the portion has been printed on that is five to ten times larger than another zone that the portion is in while being printed on.

16. A method as recited in claim 15, wherein the feeding comprise feeding the print medium through the print path of an inkjet printer.

17. A method as recited in claim 15, further comprising using no additional mechanism other than the low pressure zone to reduce cockle growth.

* * * * *